United States Patent [19]

Koda et al.

[11] Patent Number: 5,068,574

[45] **Date of Patent: * Nov. 26, 1991**

[54] LIGHTING DEVICE FOR FLUORESCENT DISCHARGE TUBE

[75] Inventors: Yoshiharu Koda; Tadashi Takashima, both of Tokyo, Japan

[73] Assignee: Kabushiki Kaisha Denkosha, Tokyo, Japan

[ * ] Notice: The portion of the term of this patent subsequent to Mar. 12, 2008 has been disclaimed.

[21] Appl. No.: 496,543

[22] Filed: Mar. 20, 1990

Related U.S. Application Data

[63] Continuation-in-part of Ser. No. 346,651, May 3, 1989, Pat. No. 4,999,546.

[30] Foreign Application Priority Data

Jan. 30, 1989 [JP] Japan ..... 1-17591
Mar. 10, 1989 [JP] Japan ..... 1-56068

[51] Int. Cl.[5] ..... H05B 37/02

[52] U.S. Cl. ..... 315/225; 315/307; 315/323; 315/DIG. 5; 315/DIG. 7

[58] Field of Search ..... 315/209 R, 225, 291, 315/307, 313, 323, DIG. 4, DIG. 5, DIG. 7

[56] References Cited

U.S. PATENT DOCUMENTS

| | | | |
|---|---|---|---|
| 4,137,484 | 1/1979 | Osteen | 315/209 R |
| 4,663,570 | 5/1987 | Luchaco et al. | 315/164 |
| 4,749,914 | 6/1988 | Feher et al. | 315/246 |
| 4,999,546 | 3/1991 | Koda et al. | 315/225 |

FOREIGN PATENT DOCUMENTS

| | | |
|---|---|---|
| 0271396 | 6/1988 | European Pat. Off. . |
| 2657824 | 7/1977 | Fed. Rep. of Germany . |
| 3233655 | 5/1983 | Fed. Rep. of Germany . |
| 59-175598 | 10/1984 | Japan . |
| 61110903 | 2/1988 | Japan . |

*Primary Examiner*—Robert J. Pascal
*Attorney, Agent, or Firm*—Gordon W. Hueschen

[57] ABSTRACT

In this invention, pulse generating means is adapted to emit a high-frequency pulse signal of a fixed duty ratio and a discharge tube is lighted by means of this pulse signal. The frequency of the pusle emitted by the pulse generating means is adjustable by adjusting means. Thus, one discharge tube lighting device of this invention can be used interchangeably for lighting discharge tubes varying in capacity. The lighting device is further capable of effecting adjustment of light in a wide range. Further, sequential potential forming means is adapted to allow a plurality of discharge tubes to be sequentially lighted with intervals. When a plurality of discharge tubes are to be lighted, therefore, the rectifying means necessary for the lighting is allowed to have only a small capacity. The high-voltage applying means for applying high voltage to the discharge tubes are connected to the electrodes disposed at the opposite terminals of the discharge tubes with connecting wires joined one each to the electrodes. At the time that the discharge tubes are to be started, the electrodes are not required to be preheated. The discharge tubes, therefore, can be lighted even when the ambient temperature is very low.

2 Claims, 7 Drawing Sheets

30KHZ

Duty ratio 50%

50KHZ

Duty ratio 50%

Characteristics of starting frequency and illuminance in using 40-W linear type fluorescent discharge tube Characteristics of power consumption and illuminance in using 40-W linear type fluorescent discharge tube

LIGHTING DEVICE FOR FLUORESCENT DISCHARGE TUBE

This is a continuation-in-part application Ser. No. 346,651, filed May 3, 1989 now U.S. Pat. No. 4,999,546, issued Mar. 12, 1991.

BACKGROUND OF THE INVENTION

1. Field of the Invention:

This invention relates to a discharge tube lighting device for lighting a discharge tube, especially a fluorescent discharge tube. More particularly, this invention relates to a discharge tube lighting device which is capable of not only lighting highly efficiently fluorescent discharge tubes of a rich variety of kinds but also allowing adjustment of light over a wide range and which, when used in a system composed of a multiplicity of fluorescent discharge tubes, enables the individual fluorescent discharge tubes to be sequentially lighted.

2. Description of the Prior Art:

Generally for the purpose of lighting a fluorescent discharge tube, there is required a lighting device which is vested with a function to apply to the opposite terminals of the fluorescent discharge tube a voltage exceeding the continuous discharge voltage of the fluorescent discharge tube at the time that the discharge is to be started and a function to regulate an electric current flowing through the fluorescent discharge tube and, at the same time, stabilize an electric current flowing in for checking fluctuation of voltage of the power source after the fluorescent discharge tube is turned off because the fluorescent discharge tube possesses a property of failing to effect desired start of the discharge unless a voltage several times the continuous discharge voltage is applied at the time that the discharge is to be started and, on the other hand, a negative property of keeping at a fixed magnitude the opposite-terminal voltage in spite of an increase in the feed current during the continuous discharge.

Most, if not all, lighting devices which are utilized most popularly today make direct use of a commercial-frequency power source. Their operating principle resides in lighting a fluorescent discharge tube of a small capacity by means of a glow tube and a choke coil (stabilizer) or lighting a fluorescent discharge tube of a medium or large capacity instantaneously by means of a stabilizer fitted with a special winding capable of functioning as a heater circuit and a high-voltage circuit. Very recently, a lighting device which is composed of electronic circuits and enabled to light a fluorescent discharge tube with the high-frequency voltage emitted from the electronic circuits as disclosed in Japanese Utility Model Application Disclosure SHO 63(1988)-18,797 has been gaining in popularity. The conventional lighting device of a small capacity, because of the principle that the lighting relies on the action of a glow tube, necessitates a choke coil of a relatively large capacity and renders a dimensional reduction extremely difficult. The conventional lighting device of a medium or large capacity, for the same reason as given above, renders it extremely difficult to attain a dimensional reduction. An attempt at imparting an advanced function such as adjustment of light to the conventional lighting device is impracticable by reason of the characteristic inherent in the construction of the device. It has been difficult, therefore, for the conventional lighting device to light a fluorescent discharge tube more efficiently through adjustment of light. The lighting device composed of electronic circuits as described above is capable of effecting such adjustment of light as described above to some extent. Any attempt at enabling a sole lighting device to attain stable adjustment of light in a wide range and, at the same time, effect highly efficient lighting of a fluorescent discharge tube is realized only to a limited extent. Further, the conventional lighting devices are such that they are used exclusively for fluorescent discharge tubes of severally proper ratings. Where the production is contemplated on a commercial scale, therefore, it has been necessary to produce lighting devices of numerous types fitting various kinds and capacities of fluorescent discharge tubes marketed, such as lighting devices adapted exclusively for 40-W straight-tube type fluorescent discharge tubes and lighting devices adapted exclusively for 20-W circle-type fluorescent discharge tubes, for example. For simultaneous lighting of a plurality of fluorescent discharge tubes by the use of conventional lighting devices, it is necessary either to furnish the fluorescent discharge tubes one each with lighting devices or to provide them with a power source and a rectifying circuit both large in size and capacity enough to attain simultaneous lighting of the plurality of fluorescent discharge tubes. The lighting devices, therefore, suffer from dimensional augmentation and entail an addition to power consumption and prove to be highly disadvantageous in terms of weight, volume, cost, and power consumption, for example. Moreover, the rush current of high amperage which occurs at the time of lighting such fluorescent discharge tubes brings about an adverse effect on internal circuit elements. In the worse case, the adverse effect may amount to destruction or serious damage to the circuit elements.

SUMMARY OF THE INVENTION

This invention has been conceived in the urge to solve the various problems of the prior art mentioned above. The first object of this invention is to provide a discharge tube lighting device which is capable of lighting a fluorescent discharge tube with high efficiency and, at the same time, allowing adjustment of light in a wide range and which is usable for a fluorescent discharge tube of a varying type. The second object of this invention is to provide, for a system composed of a plurality of fluorescent discharge lamps and intended to have these fluorescent discharge lamps lighted practically at one time, a discharge tube lighting device which, by causing the fluorescent discharge tubes to be sequentially started at intervals of a very minute span thereby decreasing the rush current at the time of lighting to the fullest possible extent and permitting dimensional reduction in the power source and the rectifying device, is made to enjoy light weight, compactness of construction, and economy of operation.

To accomplish the first object described above, this invention produces a fluorescent discharge tube lighting device comprising rectifying means connected to an AC power source and adapted to transform an AC voltage from the AC power source into a stable DC voltage, pulse generating means driven by the DC voltage issued from the rectifying means and consequently caused to emit high-frequency pulse signals of a fixed duty ratio, adjusting means for varying the frequency of the pulse issued from the pulse generating means, high-voltage applying means for applying high voltage to a discharge tube, and switching means for driving the high-voltage applying means synchronously with the high-frequency pulse signals issued from the pulse generating means.

In the fluorescent discharge tube lighting device configured as described above, the rectifying means transforms the AC voltage from a commercial power source into a stable DC voltage of extremely small ripple. This DC voltage is applied to the pulse generating means, which in response thereto emits high-frequency pulse signals having a frequency set by the adjusting means and a fixed duty ratio. The switching means produces a switching motion synchronously with the high-frequency pulse signals, applies high voltage to the discharge tube through the medium of the high-frequency applying means, and causes the discharge tube to emit light of desired luminance. Since the frequency of the pulses issued from the pulse generating means is adjusted by the adjusting means and the duty ratio of the pulses is not varied by a change in the frequency thereof as described above, one and the same discharge tube lighting device of this invention can be used interchangeably for discharge tubes varying in capacity. Further, the device allows modulation of light to be effected stably in a wide range. To accomplish the second object described above, this invention produces a fluorescent discharge tube lighting device comprising rectifying means connected to an AC power source and adapted to transform an AC voltage from the AC power source into a stable DC voltage, sequential electric potential forming means for sequentially bringing a plurality of output terminals with severally varied time constants to prescribed electric potentials in accordance with the DC voltage applied by the rectifying means, and a plurality of high-voltage applying means connected one each to the output terminals and adapted to apply high voltage severally to the plurality of discharge tube connected thereto and consequently light the plurality of discharge tubes when the electric potentials of the output terminals reach the prescribed potentials, whereby the plurality of connected discharge tubes are sequentially lighted with intervals. The electrodes formed on each at the opposite terminals of the discharge lamps are connected severally with one connecting wire to the high-voltage applying means so that the discharge tubes may be lighted without requiring the electrodes to be preheated. In the lighting device for a system of a plurality of fluorescent discharge tubes configured as described above, the rectifying means operating in the same manner as described above emits a stable DC voltage and the sequential electric potential forming means, based on the DC voltage, sequentially bring the output terminals to prescribed electric potentials with time lags due to severally varied time constants. The high-voltage applying means start operating in the order in which the corresponding output terminals reach their prescribed voltages and, in this order, apply high voltage to the corresponding discharge tubes. Thus, the lighting device can light a plurality of discharge tubes sequentially. This discharge tube lighting device, even when used in a system composed of a plurality of discharge tubes, allows the required rectifying means a dimensional reduction and consequently enjoys light weight, compactness of construction, and economy of operation. The high-voltage applying means mentioned above applies high voltage to the electrodes formed one each at the opposite terminals of the discharge tubes through the medium of connecting wires led severally to the electrodes. In this arrangement, therefore, the discharge tubes can be lighted without requiring the electrodes to be preheated. The lighting device, therefore, is enabled to light discharge tubes infallibly even when the ambient temperature is extremely low. The starting time required for this lighting is not appreciably affected by the ambient temperature and remains virtually constant.

DETAILED DESCRIPTION OF THE INVENTION

Figure 1:
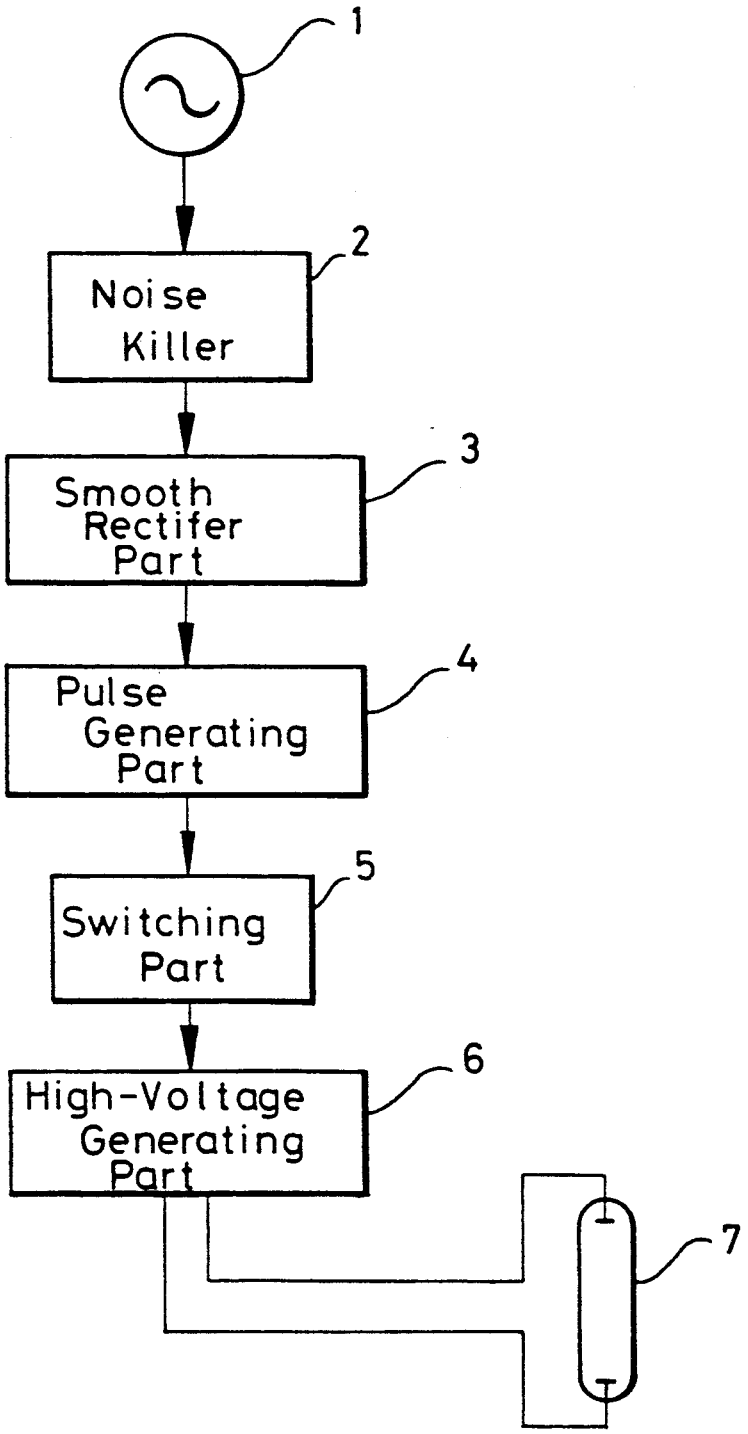
FIG. 1 is a block diagram illustrating the configuration of a discharge tube lighting device of this invention for the accomplishment of the first object described above.

FIG. 1 is a block diagram illustrating the basic configuration of the discharge tube lighting device of this invention.

This diagram depicts a discharge tube lighting device which is capable of providing efficient and stable lighting of a fluorescent discharge tube by rectifying an AC voltage supplied from an AC power source into a DC voltage, forming a pulse of a fixed duty ratio based on the DC voltage, and supplying electric power of high voltage proportionate to the pulse to the fluorescent discharge tube. In this discharge tube lighting device, adjustment of light is stably obtained in a wide range because the frequency of the pulse can be adjusted with the duty ratio of the pulse retained in a constant state.

As illustrated, a noise killer 2 for eliminating the noise intruding through an AC power source 1 or preventing the noise produced in the discharge tube lighting device from being delivered to the AC power source 1 is connected to the AC power source 1. To the noise killer 2 is connected a smooth rectifier part 3 which serves as rectifying means for transforming the AC voltage supplied from the AC power source 1 into a stable DC voltage having a very small ripple. Then, to this smooth rectifier part 3, a pulse generating part 4 which serves as pulse generating means adapted to be driven by the DC voltage emitted from the smooth rectifier part is connected. This pulse generating part 4 is vested with a function to generate a pulse of high frequency having the duty ratio thereof set at a fixed level. The frequency of this pulse thus generated is freely adjusted by an adjusting element (not shown) which is connected to the pulse generating part 4. A switching part 5 serving as switching means for producing a switching motion synchronously with the high-frequency pulse issued from the pulse generating part 4 is connected to the pulse generating part 4. It is by this switching part 5 that the operation of the high-voltage generating part 6 as high-voltage applying means for applying high voltage to a fluorescent discharge tube 7 is controlled. This high-voltage generating part 6 is endowed with the function of a stabilizer which, at the time that the fluorescent discharge tube 7 is to be started, applies very high voltage to electrodes 7A, 7B disposed at the opposite terminals of the fluorescent discharge tube 7 to light the fluorescent discharge tube 7 without requiring a filament generally possessed by the fluorescent discharge tube 7 to be preheated and, while the fluorescent discharge 7 is in the state of continuous discharge, causes the fluorescent discharge tube 7 to provide continued discharge stably.

In the configuration described above, the noise killer 2 eliminates the noise from the AC voltage supplied from the AC power source 1, the smooth rectifier part 3 rectifies the noise-free AC voltage into a DC voltage, and the pulse generator part 4, on receiving the DC voltage as input, forms a pulse of a fixed duty ratio and a freely set frequency and emits this pulse as output to the switching part 5. The switching part 5 operates the high-voltage generating part 6 synchronously with the pulse and this high-voltage generating part 6 supplies electric power of high voltage synchronous with the pulse to the fluorescent discharge tube 7 and lights the fluorescent discharge tube 7. The light from the fluorescent discharge tube 7 can be adjusted by regulating the frequency of the pulse formed by the pulse generating part 4 because this regulation results in a proportioante variation in the average applied voltage and feed electric power of the fluorescent discharge tube 7. The average applied voltage and the feed electric power enable the fluorescent discharge tube 7 to be lighted efficiently and stably because the pulse emitted from the pulse generating part 4 has the duty ratio thereof retained at a fixed level and the frequency thereof allowed to be regulated.

A typical discharge light as one embodiment of this invention of the configuration described above will be described in detailed below with reference to the circuit diagram of FIG. 2.

Figure 2:
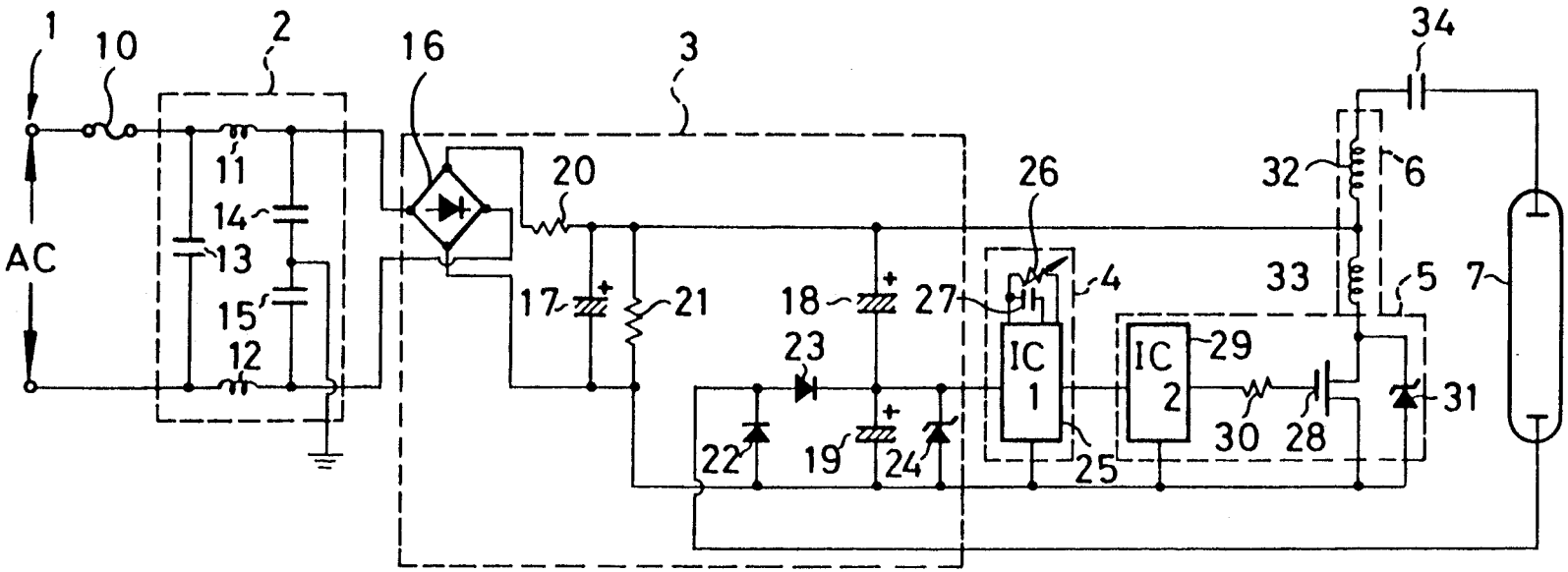
FIG. 2 is a circuit diagram of a typical discharge tube lighting device as the first embodiment of this invention.

FIG. 2 is a specific circuit diagram of the discharge tube lighting device according with this invention.

As illustrated in this diagram, the noise killer 2 shown in FIG. 1 is connected via a fuse 10 to the AC power source 1. This noise killer 2 is a bandpass filter which comprises noise removing coils 11, 12 and noise removing capacitors 13, 14, and 15.

This noise killer 2 prevents a high-frequency switching noise generated by the switching operation of the switching part 5 from flowing back to the AC power source or the noise such as high frequency suffered to occur in the AC power source from intruding the lighting device and thereby enables the lighting device to operate stably and prevents the lighting device from imparting the adverse effect of noise to the peripheral devices.

To the noise killer part 2 is connected the smooth rectifier part 3. This smooth rectifier part 3 comprises a rectifier 16 for effecting full-wave rectification of the AC voltage emitted from the noise killer 2, smooth capacitors 17, 18, and 19 for smoothing the ripple-rich DC voltage resulting from the full-wave rectification, a rush current inhibiting resistor 20 for inhibiting adverse effects of rush current, a bleeder resistor 21, rectifying diodes 22 and 23, and a constant-voltage diode 24. To the diodes 22 and 23, the electrode 7B disposed inside the fluorescent discharge tube 7 is connected through the medium of a connecting wire L2.

The DC voltage which has been given full-wave rectification by the rectifier 16 obtained by forming a bridge circuit thereof with diodes or thyristors is first smoothened mainly by the rectifying capacitor 17 and then treated with the rectifying capacitors 18 and 19 to give rise to a voltage for application to an astable multivibrator which will be specifically described hereinafter. The split voltage of the rectifying capacitor 19 is applied to the astable multivibrator. The constant-voltage diode 24 restricts the potential of the split voltage so that the voltage applied to the astable multivibrator may not increase excessively.

Figure 3A:
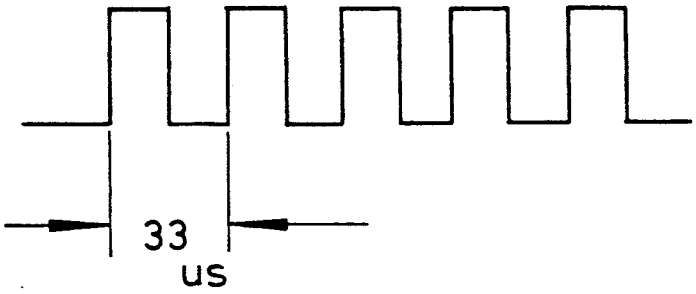
FIG. 3A and FIG. 3B are diagrams each illustrating a typical high-frequency pulse issued from an astable multivibrator shown in FIG. 2.
Figure 3B:
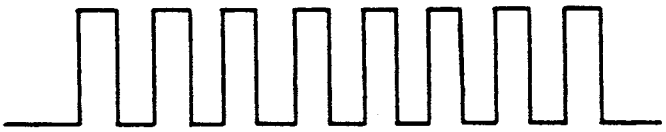

The DC voltage produced by the smooth rectifier part 3 in the manner described above is emitted as output to the pulse generating part 4. This pulse generating part 4 is composed of an astable multivibrator 25 for generating a high-frequency pulse of a fixed duty ratio (50% in the present embodiment) and a variable resistor 26 and a capacitor 27 connected to the astable multivibrator 25 so as to adjust the frequency of the high-frequency pulse emitted from the astable multivibrator 25. The variable resistor 26 and the capacitor 27 make up adjusting means. The astable multivibrator 25 is a commercially available IC. From this astable multivibrator 25 is emitted a high-frequency pulse possessing a duty ratio set at 50% as illustrated in FIG. 3A and FIG. 3B and having a frequency set freely by the variable resistor 26. In other words, the astable multivibrator 25 is enabled, by variation of the magnitude of resistance of the variable resistor 26, to emit as output a high-frequency pulse possessing a fixed duty ratio of 50% and having a varied frequency.

The high-frequency pulse emitted as output from the astable multivibrator 25 as described above is fed to the switching part 5. This switching part 5 is composed of a field effect transistor (FET) 28, a FET driving IC 29 for emitting as output a switching signal for driving the field-effect transistor 28, an overcurrent preventing resistor 30 for preventing the field effect transistor 28 from being adversely affected by overcurrent possibly injected by the FET driving IC 29 for some cause or other into the field effect transistor 28, and a surge absorber 31 for protecting the field effect transistor against surge voltage.

The FET driving IC 29 is intended to produce a switching signal of voltage enough for driving the field effect transistor 28 synchronously with the high-frequency pulse emitted from the astable multivibrator 25. The FET driving IC 29, similarly to the astable multivibrator 25, is a commercially available IC.

The switching signal issued from the FET driving IC 29 is injected through the medium of the resistor 30 into a gate terminal of the field effect transistor 28 and so as to switch the field effect transistor 28 synchronously with the high-frequency pulse mentioned above.

Further, to the drain terminal of the field effect transistor 28 is connected an autotransformer 6 formed of windings 32 and 33 and intended as a high-voltage generating part. This autotransformer 6 produces high voltage in response to the switching motion mentioned above, applies this high voltage via the connecting wire L1 to the electrode 7A of the fluorescent discharge tube 7 through the medium of a capacitor 34 serving the purpose of checking the DC component of the high voltage, starts discharge between this electrode 7A and an electrode 7B opposed to the electrode 7A, and lights the fluorescent discharge tube 7. In other words, the field effect transistor 28 operates synchronously with the high-frequency pulse emitted as output from the astable multivibrator 25 and the autotransformer 6 applies the high voltage to the fluorescent discharge tube 7 synchronously with the switching motion of the field effect transistor 28.

The discharge tube lighting device of the present invention configured as described above operates as follows.

The AC voltage supplied from the AC power source 1 and relieved of the noise by the noise killer 2 is transformed by the smooth rectifier part 3 into a DC voltage. When the astable multivibrator 25 participating in the formation of the pulse generating part 4 is driven by the DC voltage, it emits a high-frequency pulse having a frequency freely set by the variable resistor 26. The high-frequency pulse emitted as output is a pulse whose duty ratio is set at 50% as shown in FIG. 3A and FIG. 3B.

This high-frequency pulse is fed to the FET driving IC 29 as a component of the switching part 5. The FET driving IC 29 converts this high-frequency pulse into a switching signal of voltage capable of operating the field effect transistor 28. By the switching signal which is supplied to the field effect transistor 28, the field effect transistor 28 is caused to produce a switching motion. As the result, the autotransformer 6 generates high voltage of pulse synchronized with the switching motion and consequently lights the fluorescent discharge tube 7.

The frequency of the high voltage supplied to the fluorescent discharge tube 7 is fixed by the switching motion of the field effect transistor 28 and the switching motion is fixed by the frequency set by the variable resistor 26 in the astable multivibrator 25. The frequency of the high voltage supplied to the fluorescent discharge tube 7 can be adjusted by controlling the variable resistor 26. As the result, the average applied voltage and the feed electric power of the fluorescent discharge tube 7 are varied to permit modulation of the light of the fluorescent discharge tube 7.

The results of a test performed on the fluorescent discharge tube 7 for adjustment of light by the use of the variable resistor 26 will be described below with reference to FIG. 4 and FIG. 5.

Figure 4:
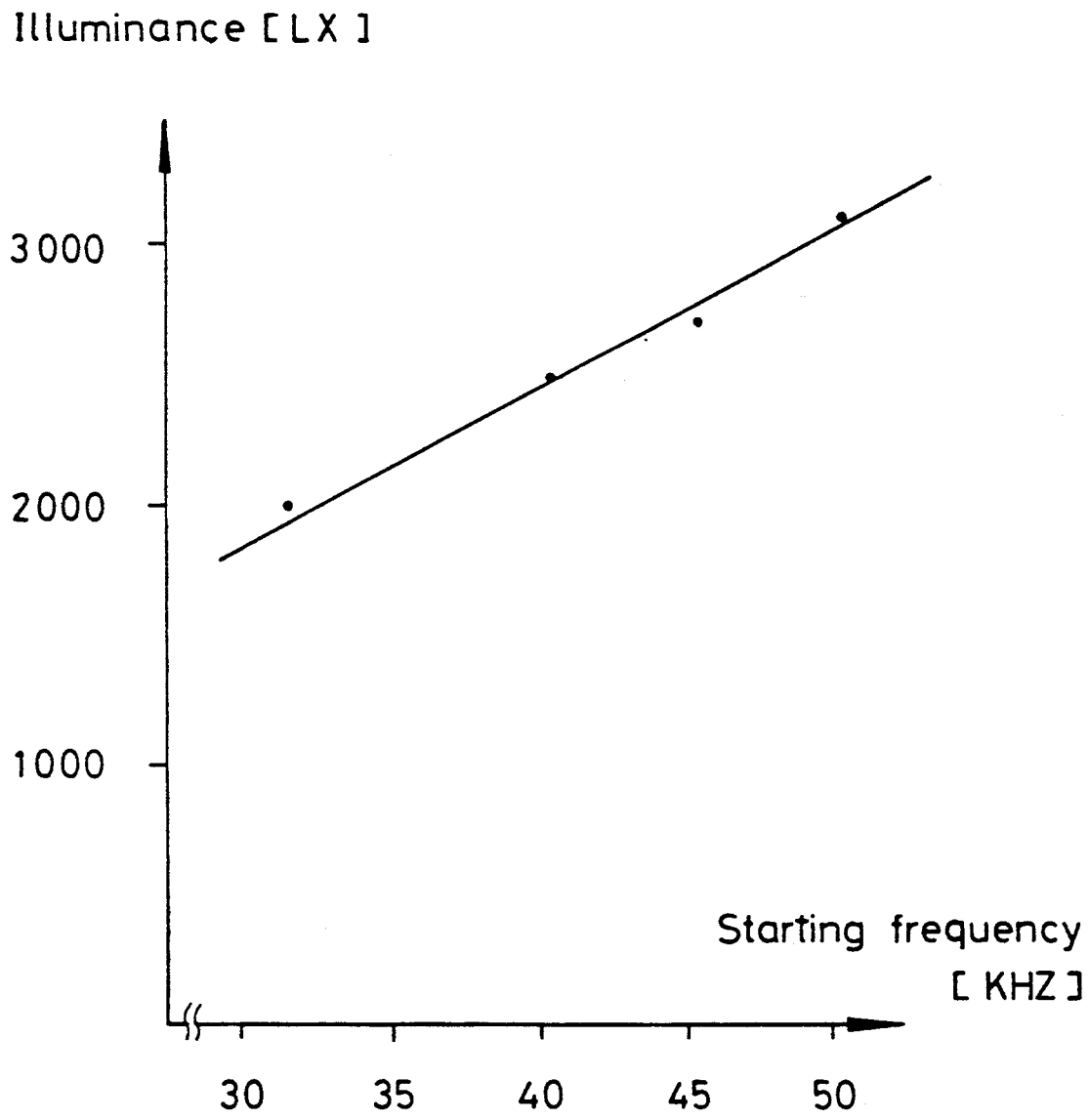
FIG. 4 is a diagram showing the characteristics of oscillation frequency and illumination observed when a fluorescent discharge tube is lighted in the circuit shown in FIG. 2.
Figure 5:
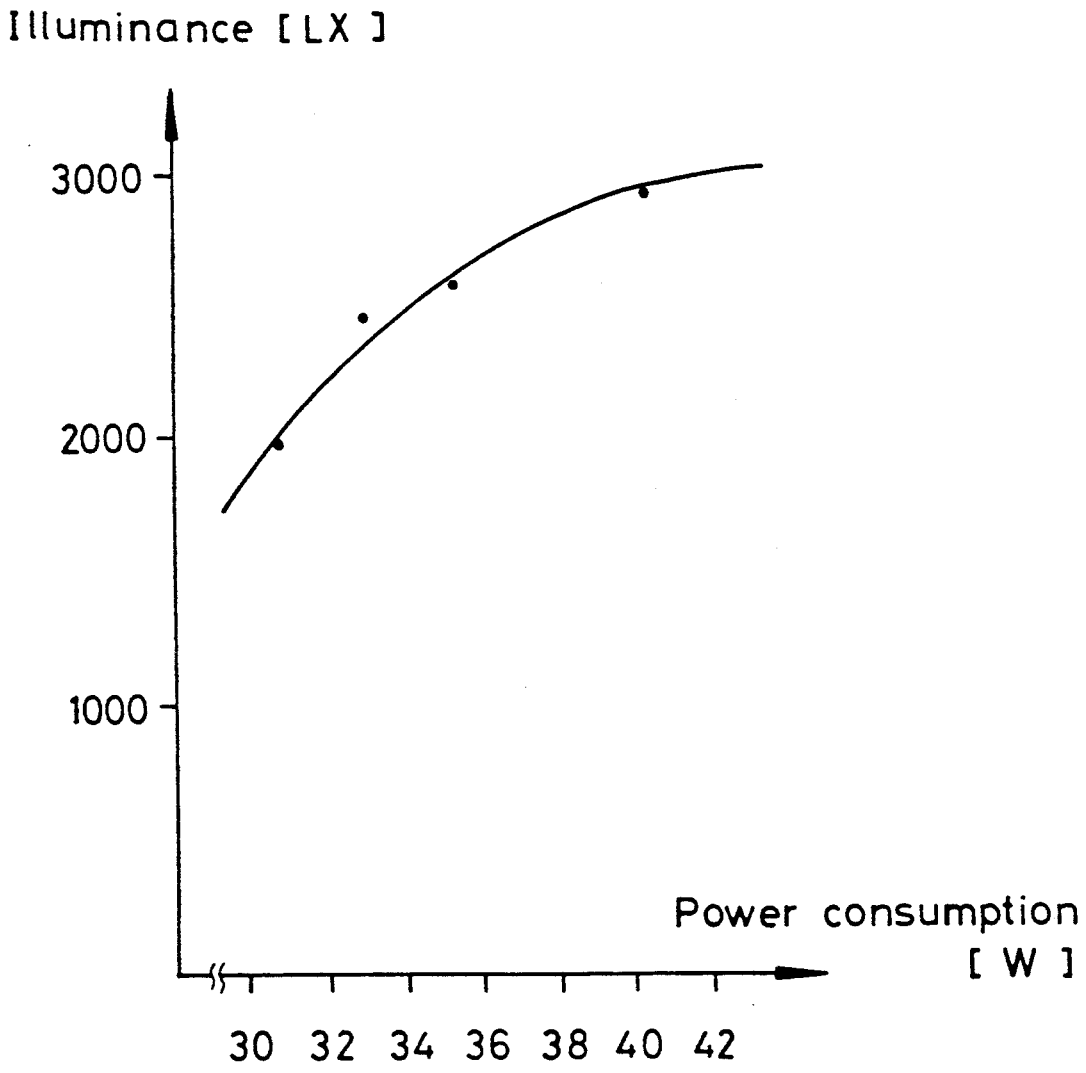
FIG. 5 is a diagram showing the characteristics of power consumption and illumination observed when a fluorescent discharge tube is lighted in the circuit shown in FIG. 2.

FIG. 4 represents a characteristic curve between starting frequency and illuminance in the actual lighting of a 40-W straight-tube type fluorescent discharge tube using the circuit described in the present embodiment.

It is noted from this diagram that a linear relation existed between the starting frequency of the high-frequency pulse regulated by the variable resistor 26 and emitted from the astable multivibrator 25 and the illuminance of the fluorescent discharge tube 7. In the test which yielded the characteristic curve, this characteristic curve was obtained by varying the frequency of the high-frequency pulse emitted as output from the astable multivibrator 25 through the regulation of the magnitude of resistance of the variable resistor 26 from 30 KHz to 50 KHz, measuring the magnitudes of illuminance corresponding to the varied magnitudes of resistance with the aid of an illuminometer, and plotting the two sets of variables thus obtained. In this test, though the frequency was varied over a wide range and the illuminance was consequently varied in a relatively wide range, the light of the fluorescent discharge tube 7 was retained very stably during this variation of the illuminance thereof. In other words, the data indicate that the modulation of light could be attained stably over a very wide range. It is because the high-frequency pulse has the duty ratio thereof kept at a fixed level and the frequency thereof alone left to be varied that the modulation of light can be stably attained over a wide range. When the modulation of light is tried by varying the duty ratio, the time of supply of the voltage applied to the fluorescent discharge tube 7 is conspicuously shortened relative to the time not spend for the supply of the voltage in proportion as the illuminance is lowered by the adjustment of light and this shortening of the time of the supply inhibits stable discharge. When the adjustment of light is effected by varying the frequency instead of varying the duty ratio as in the present embodiment, the discharge is stably maintained because the ratio between the time spend in the supply of the voltage applied to the fluorescent discharge tube 7 and the time not spend in the supply of the voltage is constant.

Now, the power consumption in the adjustment of light of the fluorescent discharge tube 7 will be described below with reference to FIG. 5.

This diagram represent a characteristic curve of power consumption and illuminance obtained in the actual lighting of a 40-watt straight-tube type fluorescent discharge tube using the circuit described in the present embodiment.

It is noted from this diagram that a curvilinear relation existed between the power consumption and the illuminance. In the test which yielded this characteristic curve, this characteristic was obtained by varying the frequency of the high-frequency pulse emitted as output from the astable multivibrator 25 through regulation of the magnitude of resistance of the variable resistor 26 approximately in the range of 30 KHz to 50 KHz, measuring the magnitudes of illuminance at the varied magnitudes of power consumption with the aid of an illuminometer, and plotting the two sets of variables thus obtained. Again in this test, the light of the fluorescent discharge tube was stably maintained during the variation of the illuminance over a wide range for the reason given above. The discharge tube lighting device of this invention, therefore, can be used in lighting fluorescent discharge tubes varied in capacity. When the discharge tube lighting device of this invention is to be used in lighting a 20-W fluorescent discharge tube, for example, it can be finished as a lighting device for exclusive use for a 20-W fluorescent discharge tube by adjusting the variable resistor 26 and setting the magnitude of resistance to a prescribed level while the device is in the process of manufacture. When the discharge tube lighting device is to be used in lighting a 40-W fluorescent discharge tube, it can be similarly finished as a lighting device for exclusive use for a 40-W fluorescent discharge tube by setting the magnitude of resistance of the variable resistor 26 to a prescribed level. Actually, when an excessively wide range is allowed for the variable capacity of the fluorescent discharge tube 7, however, there ensues the possibility that the autotransformer 6 will be required to have too large a capacity for the lighting device to be used economically for the fluorescent discharge tube 7 of a small capacity. The desirable range of the variable capacity of the fluorescent discharge tube 7, therefore, is believed to be approximately from 15 W to 40 W. When the discharge tube lighting device is provided externally with a separate variable resistor capable of regulating the magnitude of resistance of the variable resistor 26 within a certain range, it allows the fluorescent discharge tube a variation in the capacity thereof and, at the same time, permits adjustment of light of the fluorescent discharge tube 7.

The specific numerical values of power consumption, amperage, starting frequency, and illuminance collected in the aforementioned test which yielded the data described above are shown below. The following data were obtained by the use of a 40-W fluorescent discharge tube.

| Power consumption (W) | Amperage (A) | Starting frequency (KHz) | Illuminance (LX) |
|---|---|---|---|
| 30.5 | 0.580 | 32.36 | 2000 |
| 32.5 | 0.606 | 41.22 | 2500 |
| 35.0 | 0.643 | 46.36 | 2700 |
| 39.5 | 0.715 | 51.20 | 3000 |

Though an astable multivibrator 25 is used as pulse generating means in the present embodiment, the pulse generating need not be limited thereto but may be selected from among all devices which are capable of generating a high-frequency pulse. Though a field effect transistor has been cited as an example of switching means, the switching means may be selected from all devices which are capable of producing a switching motion in response to the introduction of a pulse as input.

In the discharge tube lighting device of the present embodiment which allows the frequency of the high voltage for supply to the fluorescent discharge tube 7 to be adjusted by the regulation of the variable resistor 26 and permits adjustment of the light of the fluorescent discharge tube 7, the adjustment of light can be attained by solely regulating the frequency while keeping the duty ratio constant. The adjustment of light can be effected stably. The fluorescent discharge tube 7 can be lighted efficiently even when the adjustment of light is effected as described above. This adjustment of light can be effected in a wide range proportionate to the range in which the resistance produced by the variable resistor 26 is variable. The fluorescent discharge tube 7, therefore, is used stably with the light thereof adjusted efficiently in a wide range. Further, by adjusting the frequency of the high voltage for supply to the fluorescent discharge tube 7, the electric power to be supplied to the fluorescent discharge tube 7 can be adjusted to suit the capacity of the fluorescent discharge tube given to be lighted or, straight forwardly, the adaptation of the power supply for the capacity of the fluorescent discharge tube can be attained. The lighting device, therefore, can be used interchangeably for fluorescent discharge tubes varied in lighting capacity. The lighting devices contemplated by this invention are not required to be produced in numerous types each intended exclusively for fluorescent discharge tubes 7 of a definite type. This fact is highly advantageous from the standpoint of production management. Though the adaptation in capacity mentioned above requires the process of production to incorporate therein a step for adjustment of the variable resistor 26, this step of adjustment is very easy to perform and does not obstruct the operational efficiency of production.

Now, this invention for the accomplishment of the second object mentioned above will be described in detail below with reference to FIG. 6 and FIG. 7.

Figure 6:
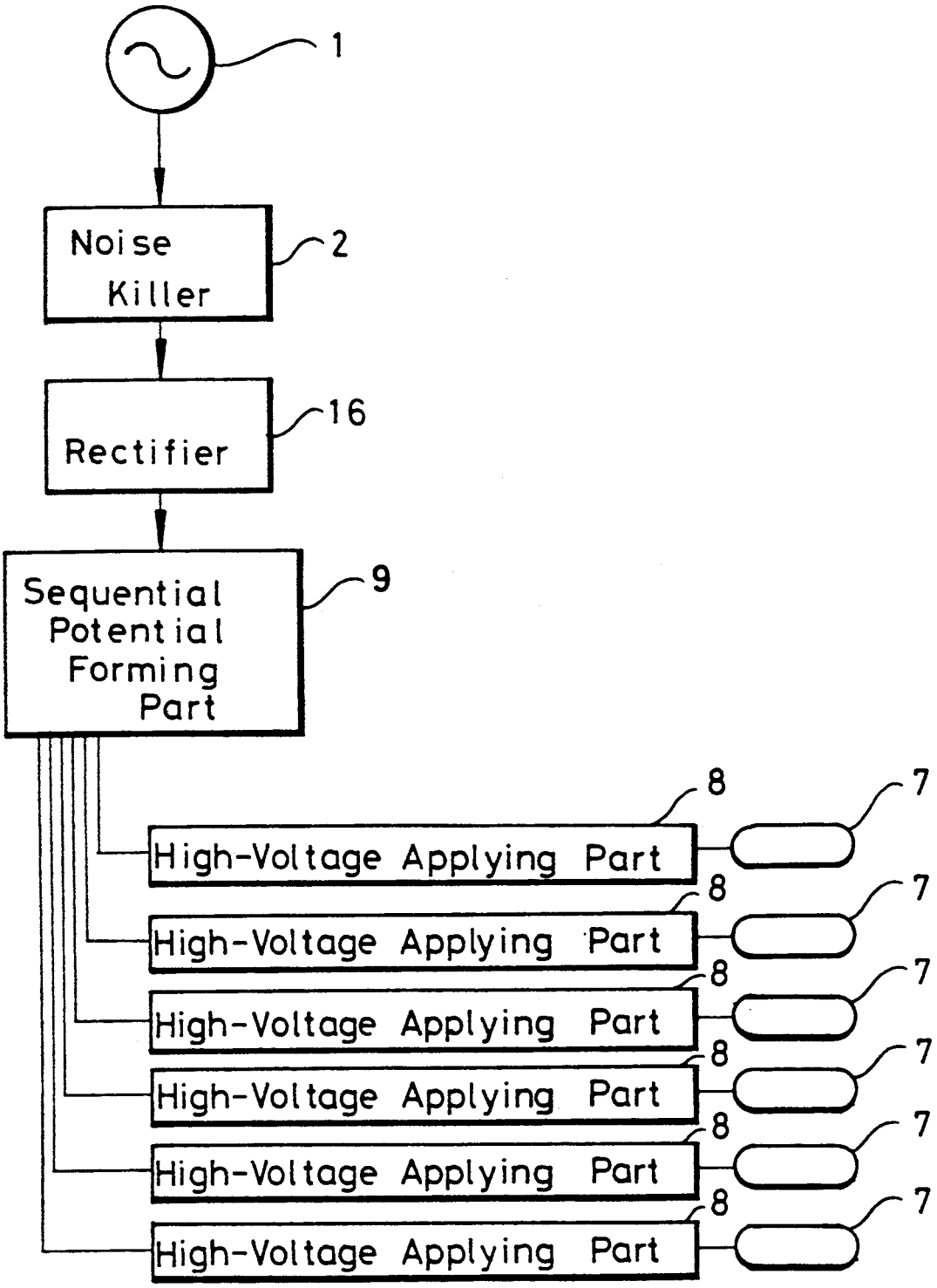
FIG. 6 is a block diagram illustrating the configuration of a discharge tube lighting device of this invention for accomplishing the second object described above.

First, to facilitate the understanding of this invention, the essence of the invention will be described with reference to the block diagram of FIG. 6 illustrating schematically the configuration of the discharge tube lighting device of this invention.

In this diagram is illustrated a lighting device which is intended for starting a plurality of fluorescent discharge tubes by rectifying an AC voltage supplied from an AC power source into a DC voltage and which is enabled to effect the lighting of the plurality of fluorescent discharge tubes with a power source and rectifying means both relatively small in capacity by causing the plurality of fluorescent discharge tubes to be lighted not simultaneously but sequentially by the use of the DC voltage mentioned above.

As illustrated, similarly to the preceding embodiment, a noise killer 2 serving the purpose of eliminating the noise intruding from an AC power source 1 or preventing the noise generated in the discharge tube lighting device from leaking into the AC power source is connected to the AC power source 1. To this noise killer 2 is connected a generated in the discharge tube lighting device from leaking into the AC power source is connected to the AC power source 1. To this noise killer 2 is connected a rectifier 16 serving as rectifying means for rectifying the AC voltage supplied from the AC power source 1 and transforming it into a DC voltage. This rectifier 16 is adapted to issue the rectified DC voltage as output to a sequential potential forming part 9 serving as sequential potential forming means. This sequential potential forming part 9 is provided with as many output terminals as the fluorescent discharge tubes 7 given to be lighted and is adapted to bring the output terminals sequentially to a prescribed potential in response to the DC voltage from the rectifier 16. To these output terminals, high-voltage applying parts 8 serving as high voltage applying means corresponding to the fluorescent discharge tube 7 are connected. These high-voltage applying parts 8 are so adapted as to apply high voltage to the respective fluorescent discharge tubes 7 and light them when the output terminals reach the prescribed potential.

Owing to the configuration described above, the AC voltage supplied from the AC power source 1 is relieved of the noise by the noise killer 2 and then rectified by the rectifier 16 into the DC voltage. The sequential potential forming part 9, in response to the DC voltage received therein as input, brings the output terminals sequentially to the prescribed potential. The high-voltage applying parts 8 connected to the output terminals supply electric power of high voltage to the fluorescent discharge tubes 7 on the condition that the output terminals have reached the prescribed potential. The fluorescent discharge tubes are consequently set lighting by the high-voltage applying parts 8 which have been set operating. When the plurality of fluorescent discharge tubes are to be lighted, since these individual fluorescent discharge tubes begin to glow at intervals, the power source having a slightly larger capacity than is normally required suffices the lighting. With a power source and a rectifier 16 both small in capacity, the plurality of fluorescent discharge tubes 7 can be lighted.

Now, a typical discharge tube lighting device of this invention configured as explained above will be described below with reference to FIG. 7.

Figure 7:
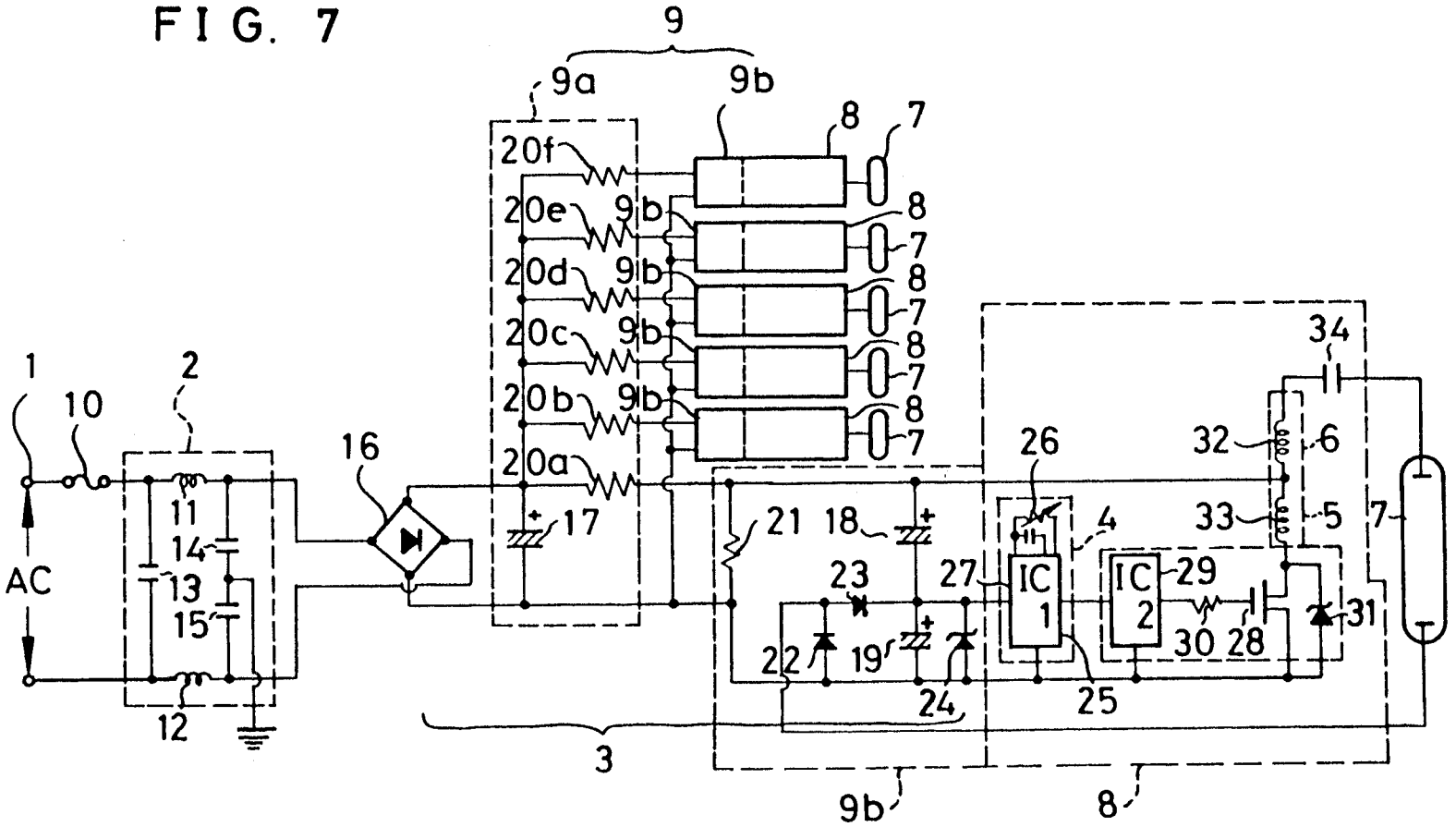
FIG. 7 is a circuit diagram forming a discharge tube lighting device as the second embodiment of this invention.

FIG. 7 is a concrete circuit diagram of the discharge tube lighting device according with this invention. It illustrates as circuit for lighting six fluorescent discharge tubes. In the circuit shown in FIG. 7, the noise killer 2, the rectifier 16, the pulse generating part, the switching part 5, and the high-voltage generating part 6 are identical to those found in the circuit described in the preceding embodiment and do not require any detailed explanation.

First, to an AC power source 1, a noise killer 2 in the form of a bandpass filter is connected through the medium of a fuse 10. This noise killer 2 is so adapted as to eliminate the noise as of high frequency from the AC voltage received as input from the AC power course 1 and supply the noise-free AC voltage to the rectifier 16 mentioned above.

To this rectifier 16 is connected a sequential potential forming part 9 which is composed of a circuit 9*a* and a circuit 9*b*. To this sequential potential forming part 9 is connected a high-voltage applying parts 8 each composed of a pulse generating part 4, a switching part 5, and a high-voltage generating part 6 as described in the preceding embodiment and severally serving the purpose of applying high voltage to the fluorescent discharge tubes 7. The rectifier 16 and the sequential potential forming part 9 jointly correspond to the smooth rectifier part 3 in the preceding embodiment.

The circuit 9*a* is composed of a capacity 17 (about 680 uF) for smoothening the ripple-rich DC voltage which has been given full-wave rectification by the rectifier 16 and resistors 20*a* to 20*f* possessed of varied magnitudes of resistance and intended for sequentially operating the pulse generating parts 4. The circuit 9*b* is formed of a bleeder resistor 21, capacitors 18 and 19 for forming split voltages as described specifically afterward, rectifying diodes 22 and 23, and a constant-voltage diode 24.

The capacity of the capacitor 17 is required to be set in advance proportionately to the number of fluorescent discharge tubes 7 given to be lighted.

The DC voltage issued from the rectifier 16 is smoothened mainly by the rectifying capacitor 17 and the voltage for application to the pulse generating part 4 is produced by the capacitors 18 and 19. The potential of the output terminal of the capacitor 19 is transformed into split voltages to be fixed by the capacitors 18 and 19. The split voltages thus obtained are applied to the pulse generating part 4. The pulse generator 4 is operated in response to the application of these split voltages which the constant-voltage diode 24 restrains the applied split voltages from growing excessively.

To the (+) terminal of the capacitor 17 are parallelly connected resistors 20*a* to 20*f*. To these resistors 20*a* to 20*f*, identical circuits 9*b* and the aforementioned high-voltage applying parts 8 are connected one each. The magnitudes of resistance of these resistors 20*a* to 20*f* are differentiated. The DC voltage rectified by the rectifier 16 and the capacitor 17 is supplied to the capacitors 18 and 19 in the magnitudes of current proportionate to the differentiated magnitudes of resistance to effect required charging of the capacitors 18 and 19. By the resistors 20*a* to 20*f* possessing severally different magnitudes of resistance and the capacitors 18 and 19 possessing one and the same capacity, time constants of severally different values are formed. The state of time-course change of the interterminal voltage of the capacitor 19 is disposed on each of the circuits 9*b* is varied by the magnitudes of resistance of the resistors 20*a* to 20*f*. The ratio of the rise of the interterminal voltage of capacitor increases in proportion as the magnitude of resistance of the resistor connected to the relevant circuit decreases. To the pulse generating parts 4, therefore, the aforementioned split voltages are applied as delayed (by several milliseconds as a unit) proportionately to the respective time constants. As the result, the pulse generating parts 4 are set operating sequentially in the order conforming to the order of magnitudes of resistance of the resistors 20*a* to 20*f*, namely in the increasing order of time constants.

Then, on the condition that the split voltages of the capacitors 19 which increase as described above have surpassed prescribed levels, the pulse generating part 4 is set operating. The pulse generating part 4, the switching part 5, and the high-voltage generating part 6 cooperate to light the fluorescent discharge tubes 7 in the manner described in the preceding embodiment. The fluorescent discharge tubes 7 are lighted sequentially in the order in which the pulse generating parts 4 are set operating.

The discharge tube lighting device of this invention configured as described above operates as follows.

The AC voltage relieved of the noise by the noise killer 2 is transformed by the rectifier 16 and the capacitor 17 into a smoothened DC voltage and supplied to the resistors 20*a* to 20*f*. By these resistors 20*a* to 20*f* and the capacitors 18 and 19 of the circuits 9*b*, the split voltages are applied to the astable multivibrators 25 serving as components of the pulse generating part 4 of each of the high-voltage applying parts 8. The astable multivibrators 25 are set operating sequentially in the order in which the split voltages have grown to levels fit for the operation thereof and are caused to emit high-frequency pulses of frequencies fixed by the set magnitudes of the variable resistors 26 and the capacities of the capacitors 27 to FET driving ICs 29 which are components of the switching part 5.

Then, the FET driving ICs 29 impart a switching motion to the field effect transistors 28 synchronously with the high-frequency pulse. By the switching motion, the autotransformers 6 are caused to emit high voltage and the fluorescent discharge tubes 7 are lighted.

Consequently, the resistors 20*a* to 20*f* and the capacitors 18 and 19, based on the DC voltage formed by the rectifier 16 and the capacitor 17, apply split voltages increased at a rate decided by the time constant at the time of starting to the respective pulse generating parts 4 and the six fluorescent discharge tubes 7 are sequentially lighted in the order in which the corresponding pulse generating parts 4 are set operating. It, therefore, suffices that the power source possesses a relatively small capacity at the time that the lighting is started. This explains why the plurality of fluorescent discharge tubes can be effectively lighted with a power source and a rectifying circuit both small in capacity. When the discharge tube lighting device of this invention is employed for lighting a plurality of fluorescent discharge tubes, it enjoys light weight and compactness of construction in addition to the advantageous effects achieved in the preceding embodiment described above and, at the same time, enables the plurality of fluorescent discharge tubes to be lighted very economically.

When the smooth capacitor 17 is vested with a large capacity proportionate to the number of fluorescent discharge tubes 7, the ripple occurring in the DC voltage to be supplied by the smooth rectifier part 3 to the pulse generating part 4 is decreased and, at the same time, the time during which the capacitor 17 discharges is lengthened. As the result, electric power can be stably supplied to the fluorescent discharge tubes 7 and the pulse generating part 4 and the fluorescent discharge tubes 7 can be stably lighted.

The comparative test performed by the present inventors on the conventional discharge tube lighting devices used one each for a plurality of fluorescent discharge tubes and on the present inventions lighting device used jointly for a plurality of fluorescent discharge tubes has yielded the results that the lighting device of this invention was 1/10 in weight, ⅓ in volume, and 2/5 in power consumption, respectively, based on the conventional lighting devices totally taken as 1.

Further, in the present embodiment, the resistors disposed in parallel connection are given differentiated magnitudes of resistance and the capacitors for deciding voltages for application to the pulse generating parts corresponding to the discharge tubes are given one equal capacity. These definitions are not particularly critical for this invention. Optionally, for example, the magnitudes of resistance may be uniformized and the capacitors may be give differentiated magnitudes of capacity. It is also permissible for the pulse generating parts to be adapted so as to be sequentially set operating in a certain order.

What is claimed is:

1. A discharge tube lighting device comprising rectifying means connected to an AC power source and adapted to transform an AC voltage from said AC power source into a stable DC voltage, pulse generating means driven by the DC voltage issued from said rectifying means and consequently caused to emit high-frequency pulse signals of a fixed duty ratio, adjusting means for varying the frequency of the pulse issued from said pulse generating means, high-voltage applying means for applying high voltage to a discharge tube, and switching means for driving said high-voltage applying means synchronously with the high-frequency pulse signals issued from said pulse generating means, wherein electrodes disposed one each at the opposite terminals of said discharge tube are severally connected with one connecting wire to said high-voltage applying means so that said discharge tube may be lighted without requiring said electrodes to be preheated.

2. A discharge tube lighting device comprising rectifying means connected to an AC power source and adapted to transform an AC voltage from said AC power source into a stable DC voltage, sequential electric potential forming means for sequentially bringing a plurality of output terminals with severally varied time constants to prescribed electric potentials in accordance with the DC voltage applied by said rectifying means, and a plurality of high-voltage applying means connected one each to said output terminals and adapted to apply high voltage severally to the plurality of discharge tubes connected thereto and consequently light the plurality of discharge tubes when the electric potentials of said output terminals reach said prescribed potentials, whereby the plurality of connected discharge tubes are sequentially lighted with intervals, wherein electrodes disposed one each at the opposite terminals of said discharge tube are severally connected with one connecting wire to said high-voltage applying means so that said discharge tube may be lighted without requiring said electrodes to be preheated.

* * * * *

UNITED STATES PATENT AND TRADEMARK OFFICE

CERTIFICATE OF CORRECTION

PATENT NO. : 5,068,574

DATED : Nov. 26, 1991

INVENTOR(S) : Yoshiharu Koda, Tadashi Takashima

It is certified that error appears in the above-identified patent and that said Letters Patent is hereby corrected as shown below:

Drawings, Sheet 1, Figure 1, No. 3; "Rectifer" should read -- Rectifier --.

Column 5, line 33; "proportioante" should read --proportionate--.

Column 5, line 44; "detailed" should read -- detail --.

Column 8, line 13; "spend" should read -- spent --.

Column 8, line 20; "spend" should read -- spent --.

Column 8, line 22; "spend" should read -- spent --.

Column 8, line 27; "represent" should read -- represents --.

Column 10, line 24 - 27, delete "To this noise killer 2 is connected a generated in the discharge tube lighting device from leaking into the AC power source is connected to the AC power source 1."

Column 13, line 25; "give" should read -- given --.

Signed and Sealed this

Thirtieth Day of March, 1993

*Attest:*

STEPHEN G. KUNIN

*Attesting Officer*

*Acting Commissioner of Patents and Trademarks*